US005451753A

United States Patent [19]

Leatherwood et al.

[11] Patent Number: 5,451,753

[45] Date of Patent: Sep. 19, 1995

[54] CURRENCY SHIELD FOR CASH DRAWER

[75] Inventors: Louis W. Leatherwood; Marion H. Leatherwood, both of Riverside; Henry C. Keck, Pasadena; Roy K. Fujitaki, Altadena; Darcy E. Staggs, Orange, all of Calif.

[73] Assignee: Lumar's Enterprises, Inc., Moreno Valley, Calif.

[21] Appl. No.: 203,562

[22] Filed: Mar. 1, 1994

[51] Int. Cl.[6] ..... G07G 1/00

[52] U.S. Cl. ..... 235/7 R; 235/10; 235/22

[58] Field of Search ..... 235/1 R, 1 E, 2, 7 R, 235/10, 22; 206/565, 562, 560, 0.84, 0.81

[56] References Cited

U.S. PATENT DOCUMENTS

| | | | |
|---|---|---|---|
| 7,648 | 9/1850 | Collord | 206/449 |
| 346,839 | 8/1886 | Butts | 24/67.7 |
| 773,102 | 10/1904 | See | 235/2 |
| 1,349,527 | 8/1920 | Owen | 206/0.81 |
| 2,735,541 | 2/1956 | Mosler | 206/81 |
| 3,892,309 | 7/1975 | Coffey et al. | 235/22 |
| 4,314,632 | 2/1982 | Hutchinson | 206/81 |

*Primary Examiner*—Russell E. Adams
*Assistant Examiner*—Eddie C. Lee
*Attorney, Agent, or Firm*—Harlan P. Heubner

[57] ABSTRACT

A money shield for insertion into a cash drawer or cash drawer insert of a cash register to overlie paper currency in one or more paper currency compartments to prevent visual inspection of currency under the shield, wherein the shield covers the area defined by a compartment and is associated with a conventional bail of the currency compartment, and the shield includes means to allow it to swing open for access to the currency yet yieldable to an at rest closed position.

13 Claims, 2 Drawing Sheets

CURRENCY SHIELD FOR CASH DRAWER

BACKGROUND OF THE INVENTION

1. Field of the Invention

This invention relates to a currency shield or shields to overlay a compartment for paper currency in a cash drawer or a cash drawer of a cash register.

2. Description of the Prior Art

Heretofore cash drawers or cash register drawers have only had individual compartments for currency and a spring loaded bail to hold down the currency in the compartment. There have not been any types of compartment overlays or covers to hide the quantity or denomination of the paper money.

U.S. Pat. No. 2,735,541 describes a coin and paper currency receptacle for storage of coins in specific receptacles and above the receptacles is a flat receptacle for paper currency. The unit is not for use in a cash register drawer but merely to provide a container for sales clerks in stores and auditing personnel, wherein there is access to the money.

In U.S. Pat. No. 773,102 a compartment has a sliding lid so that each clerk has his or her own compartment for change, etc. Again this structure does not, nor cannot serve as a releasable shield to prevent visual inspection of paper currency.

Finally, applicants are aware of U.S. Pat. No. 4,314,632 which is directed to a till insert. However, the coins 32 inserted through slot 14 are not for giving change, but separating special coins. Further the insert does not have a top that can be removed for easy access into the insert. Thus, this patent does not solve the problem of shielding the quantity and denomination of paper currency when the cash drawer is open.

SUMMARY OF THE INVENTION

It is a purpose of the present invention to provide a currency shield for use in a cash drawer or a cash register drawer either as a part of the original equipment or through the after market.

Another object of the present invention is to provide a currency shield for use in a cash drawer or a cash register drawer which is an insert placed in a currency compartment to cover the paper currency and prevent visual inspection of the contents therein.

A still further object of the present invention is to provide a paper currency shield that is an insert having a bottom wall, curved front wall portion, back vertical wall and a hinged top for access into the insert. The top may be spring loaded or not as a conventional drawer bail bears against it.

A yet further object of the present invention is to provide a modified paper currency shield that is cover member with a perimeter dimension just slightly less than the interior perimeter dimension of a paper currency compartment of a cash drawer, and the same is affixed to a conventional springloaded bail to assure easy opening and closing of said cover member.

Another object of the present invention is to provide a paper currency shield insert wherein there are hinge means to affix the insert within a currency compartment of a cash drawer of a cash register for closed and open positions.

These and other objects and advantages will become apparent from the following part of the specification wherein details have been described for the competence of disclosure, without intending to limit the scope of the invention which is setforth in the appended claims.

BRIEF DESCRIPTION OF THE DRAWINGS

These advantages may be more clearly understood from the following detailed description and by reference to the drawings in which.

DETAILED DESCRIPTION OF THE PREFERRED EMBODIMENT

Figure 1:
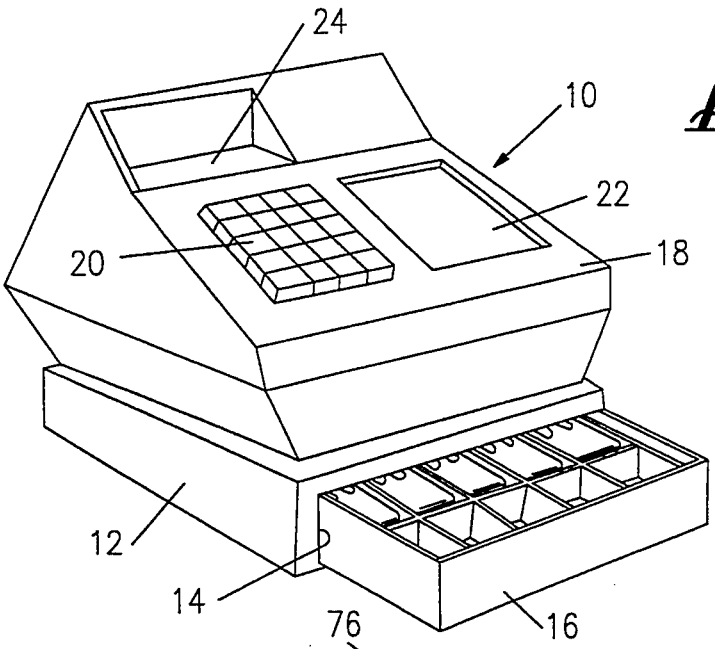
FIG. 1 is an environmental view of the present invention as it is used with a cash drawer of a conventional cash register.

In FIG. 1 there is illustrated one form of a conventional cash register means designated 10 that includes a stand 12 with a recess 14 to receive a conventional cash drawer 16. Mounted on the stand 12 is the cash register 18 with a conventional numerical keyboard 20, screen 22 to view the transaction and an upper area 24 wherein a receipt would appear to give to the customer.

The drawer 16 is usually spring loaded to open upon completion of the sales transaction so the sales clerk may deposit the cash or checks and make change.

Preferably in most cash register means or consoles 10 each cash drawer 16 is fitted with a removable cash drawer insert designated 30. The insert 30 includes side walls 32 and 34, and rear wall 36 (see FIG. 3). The bottom 38 extends from the rear wall and is generally flat to a front portion 40 that is curved upwardly and terminates on the same horizontal plane as the top edge 42 of side walls 32 and 34. In addition the insert 30 includes a forwardly extending mounting flange 44.

The interior of the insert 30 is fitted with coin compartments 46 in the front so that coins may be slid up to curved front portion 40 for easy removal.

Behind the coin compartments 46 are a series of paper currency compartments 48 to receive paper currency of various denominations and possibly checks.

The paper currency compartments 46 are each elongated with rear wall 36 and front wall 50 defining the elongated dimension. The side dimensions may be defined by walls 52 and or side walls 32 and 34 and walls 52.

The front wall 50 also defines the coin compartments 46.

Figure 2:
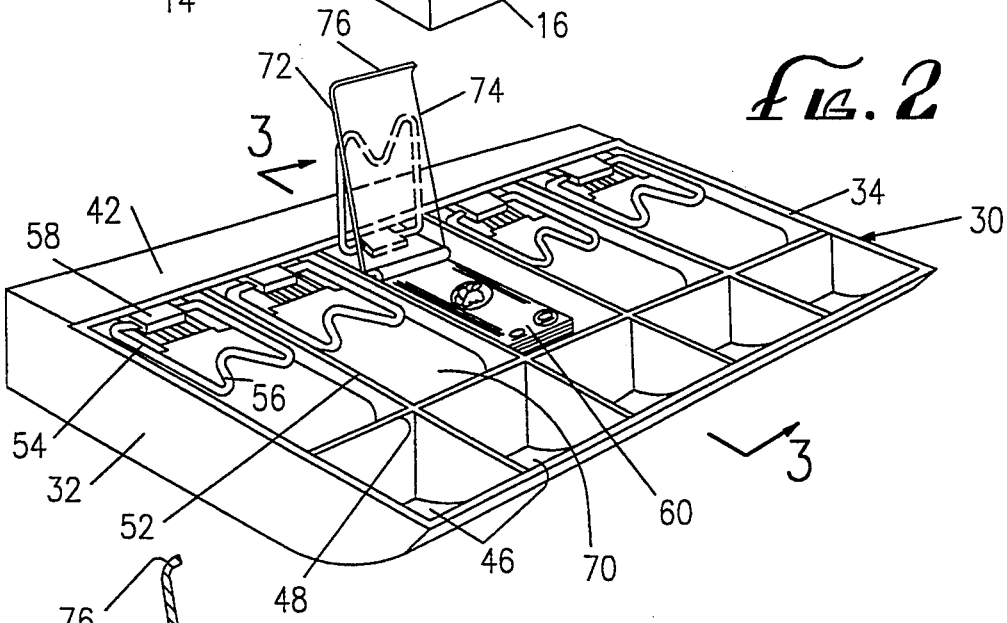
FIG. 2 is a perspective view of a cash drawer with a currency shield of the present invention mounted therein.
Figure 3:
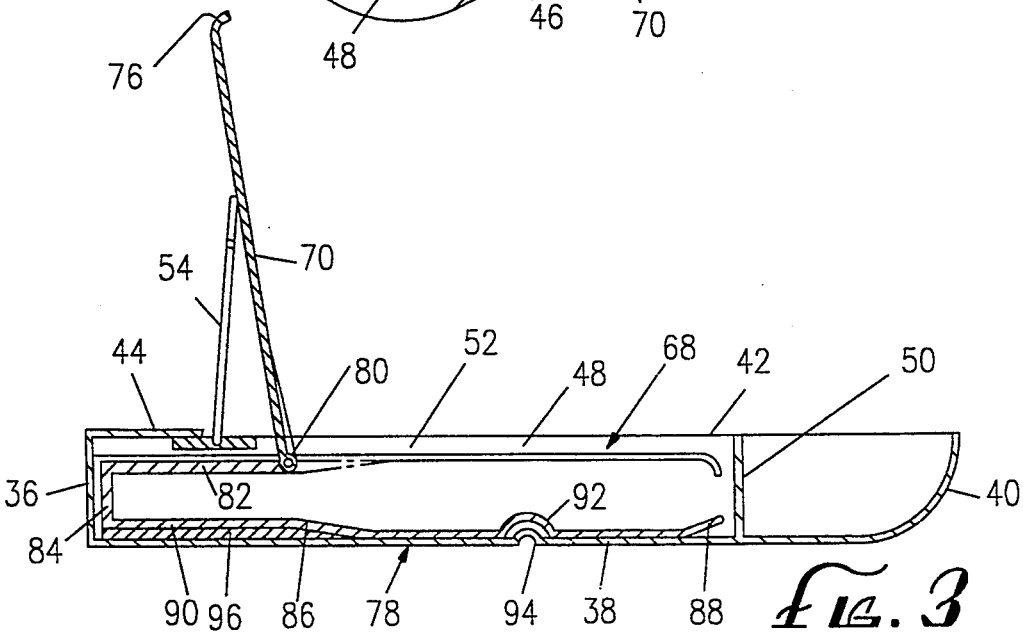
FIG. 3 is a cross-sectional view of the present invention taken on line 3—3 of FIG. 2.

Usually each paper currency compartment is fitted with a conventional wire or metal spring loaded bail 54 that is secured to the mounting flange 44 (see FIG. 3). The bail 54 can be formed of wire 56 as shown in FIG. 2 and is hinged and generally spring loaded with a torsion spring 58. A bail 54 is lifted manually by the clerk for access to the currency 60 in one or more of the compartments 48 and they usually assume open position off center from the vertical so they remain in the lifted or up position until they are pulled back down to rest on the bills or paper currency 60. Such bails 54 are conventional in cash drawers 16 except the design and shapes vary depending upon the manufacturer.

While most cash register complexes 10 include cash drawer inserts 30, others may only use the cash drawers 16. In either case the invention will operate with whichever arrangement is utilized, and the terms "cash drawer insert" and "cash drawer" may be used interchangeably.

Now turning to the present invention, a money shield or insert generally designated 68 is provided that includes a cover member or overlay portion 70 that over lies the paper currency 60. The cover member or overlay portion 70 preferably includes a width from edge 72 to edge 74 just slightly less than the width of the compartment 48. The length of the cover 70 is such that when added to the mounting flange 44 of the drawer or drawer insert 30 corresponds to the length of the compartment 48. Generally the front edge 76 is curved downward so that it will engage paper currency 60 thereunder and provide access for fingers so the cover member may be lifted.

In the preferred embodiment of the shield or insert 68, currency holder insert is designated 78 and is formed and physically placed in a paper currency compartment 48 of the drawer or drawer insert 30.

The cover or overlay portion 70 is hingedly secured by cooperative means such as hinge pin 80 to an upper extension piece 82, which extends rearwardly to a vertical end wall 84. There is a bottom wall 86 that extends from the end wall 84 forward terminating in a preferred turned up end 88. The upturned end allows an easy grasp of the insert 78 for removal from the tray 30 and for removal of paper currency 60 within the insert 68.

Figure 4:
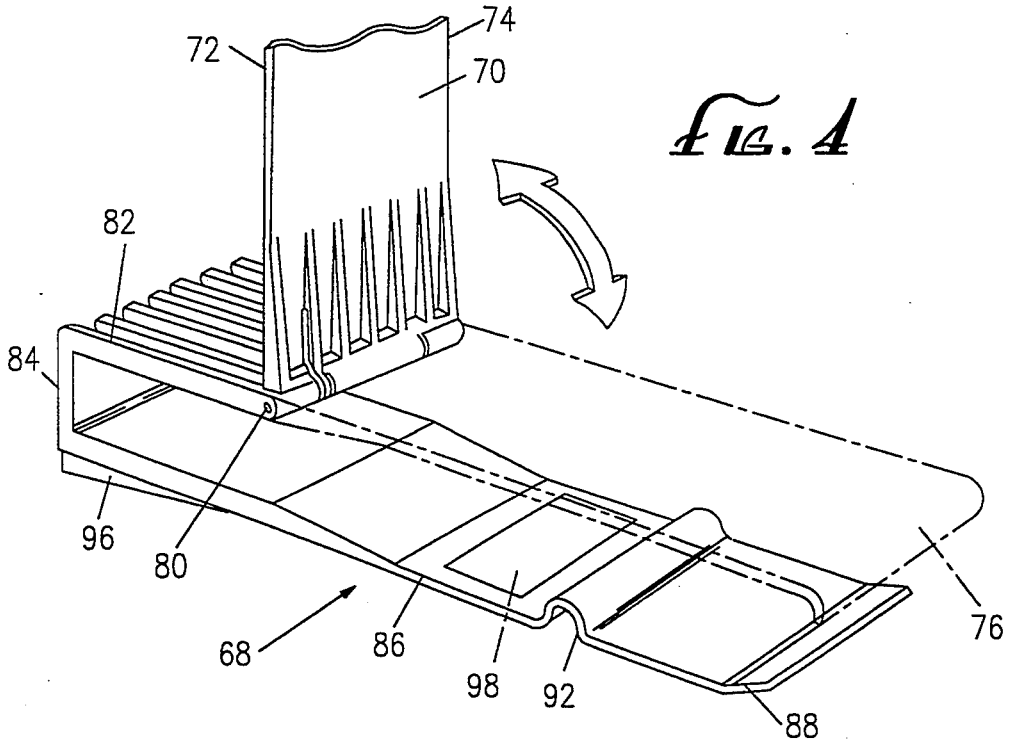
FIG. 4 is a detailed perspective view of a money shield insert of the present invention.

As can be seen in FIGS. 3 and 4 the bottom 86 may include an elevated end portion 90 in the rear portion of the shield 68 to create a void. Also there could be formed a tunnel portion 92 extending across the width of the shield to accommodate special ridge constructions 94 formed in some existing cash drawer inserts 30.

If the shield or insert 68 does not fit where the cover 70 can stay up by itself as seen in FIG. 3, because of the void and tipping of the insert the inventors provide a wedge 96 to tip the shield member forward and fix the same against rocking.

Also in order to achieve securement of the shield 68 in the drawer insert 30, an adhesive pad or two sided adhesive pad 98 may be affixed to the underportion of the bottom 86 of the money shield 68.

In operation when the drawer 16 is to be opened, the clerk may insert a finger under the top or cover 70 hingedly raising the same against a biased spring loaded bail 54 that is resting thereagainst to a slightly vertical off set position while paper currency is being added or taken from the stack of paper currency. Once the transaction is completed the clerk may manually push outward against the bail 54 or the cover 70 causing the spring loaded bail 54 to in turn close the cover 70. Alternatively, the drawer 16 may be closed which will push against the bail and in turn the cover 70 to close the same.

With the shield or insert 68 in place no one looking into the open cash drawer 16 would be able to see the denomination or quantity of paper currency therein. This may be a deterrent to robbery or just the curious from seeing the contents of the drawer 16.

It has been found that the money shield 68 may be made of a light weight plastic with good results to achieve strength, stability and a low cost factor per unit.

Figure 5:
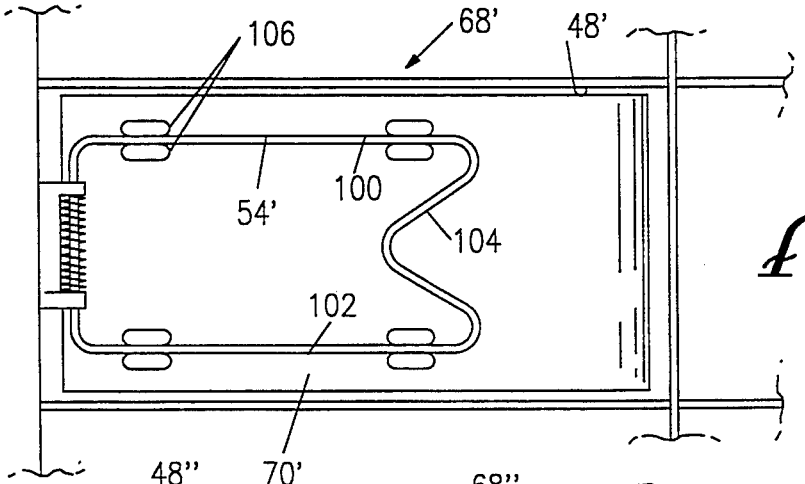
FIG. 5 is a top plan view of a modified form of money shield of the present invention.
Figure 6:
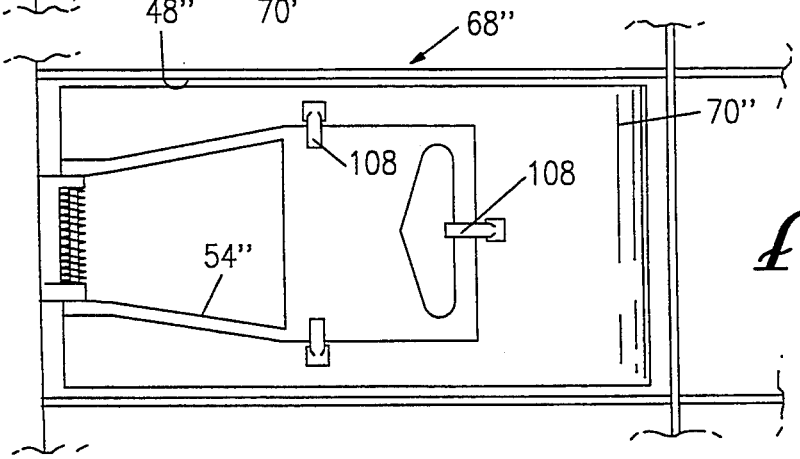
FIG. 6 is a top plan view of a second modification of FIG. 5 for affixing to one of many conventional bails used by various cash register manufactures.

In FIGS. 5 and 6 there is illustrated modified money inserts 68' and 68''. Here there is only the cover member 70' and 70''. Each cover member 70' and 70'' illustrated is generally that of a rectangle that interfits within compartments 48' and 48''. The difference resides in cooperative means for affixing the cover members 70' and 70'' to a conventional bale 54' and 54''.

In the case of FIG. 5 the bail 54' includes two parallel wire sides 100 and 102 and a curved end wire piece 104 united by the side pieces. The cover member 70' is fitted with pairs of detentes 106 spaced from one another and the wire sides may be snapped therein for frictional retention therebetween.

In FIG. 6 the bail design differs and cleats or clips 108 may be used to lock the bail 54'' to the cover 70'' for simultaneous movement.

The invention and its attendant advantages will be understood from the foregoing description and it will be apparent that various changes may be made in the form, construction and arrangements of the parts without departing from the spirit and scope thereof or sacrificing its material advantages, the arrangements herein before described being merely by way of example. We do not wish to be restricted to the specific forms shown or uses mentioned, except as defined in the accompanying claims, wherein various portions have been separated for clarity of reading and not for emphasis.

We claim:

1. A shield for use in a cash drawer of a cash register complex to physically cover paper currency within at least one paper currency compartment to prevent visual inspection of the contents of said compartment and said compartment is peripherally sized with an interior perimeter dimension and a fixed height to accommodate said paper currency, and a hinged spring loaded bail associated with said compartment adapted to overlay the same and releasably retain said currency therein yet movable to an upper open position, said shield comprising:

an insert including at least an overlay portion having an exterior perimeter dimension so as to closely conform to said interior perimeter dimension of said compartment positioned under said hinged spring loaded bail, and in a generally horizontal rest position overlaying and interfitable within said compartment to cover said currency therein, yet yieldable by upward finger pressure from said rest position to an upper open position wherein said overlay portion and said bail bearing there against are moved to a position generally vertically off set to rest and expose currency thereunder until moved by initial outward pressure against said bail or said overlay portion wherein said spring loaded bail will take over and close said bail and said cover to said original generally horizontal rest position; and cooperative means associated with said insert to allow pivotal movement of said overlay portion between positions.

2. A shield for use in a cash drawer as defined in claim 1 wherein said insert includes:

a bottom wall generally of a length corresponding to the length of said compartment and having a front end and a rear end, a rear vertical wall projecting upward from said bottom wall rear end and of a height less than the height of said compartment, a horizontal extension wall projecting from said rear wall and generally parallel with said bottom wall, and said overlay portion is hingedly mounted to said extension wall and in said rest position is generally parallel with said bottom wall, said overlay portion terminating in an end generally above said front end of said bottom wall; and said insert is insertable within said compartment to lie flat therein with said bail making engaging contact with said cover and paper currency is placed or removed from between said bottom wall and said cover.

3. A shield for use in a cash drawer as defined in claim 2 wherein;

said end of said cover is curved downwardly and is adapted to engage paper currency within said compartment and maintain said currency in position and to allow a finger to be inserted at least partially under said cover to move the same from said rest position to said vertical off set position.

4. A shield for use in a cash drawer as defined in claim 2 wherein;

said front end of said bottom wall is curved upwardly to assist in easy removal of said paper currency placed in said insert.

5. A shield for use in a cash drawer as defined in claim 2 wherein;

said bottom wall of said insert includes an exterior surface; and adhesive is applied to at least a portion of said exterior surface to affix said insert to said compartment.

6. A shield for use in a cash drawer as defined in claim 2 wherein;

said bottom wall in a rear area adjacent said vertical rear wall is stepped above the remainder of said bottom wall wherein there is a cover adjustment void between the stepped portion and a bottom surface of said compartment allowing said insert to shift up or down to assure said cover an open or up over center position.

7. A shield for use in a cash drawer as defined in claim 6 wherein;

a wedge is provided for said cover adjustment void to stabilize said insert.

8. A shield for use in a cash drawer as defined in claim 1 wherein:

said overlay portion is a cover member, including mounting means on said cover member to affix the same to said bail for simultaneous movement.

9. A shield for use in a cash drawer as defined in claim 8 wherein;

said bail is formed of wire bent and formed to a general rectangle with a pair of parallel side walls portions and an end portion hingedly mounted to said cash drawer; and said mounting means are at least one pair of detents formed on said cover member and said wire is snapped thereinto for simultaneous movement of said cover member and said bail.

10. A shield for use in a cash drawer as defined in claim 8 wherein;

said bail is a formed member having some solid areas therein; and said mounting means are clips mounted on said cover member that engage said bail for simultaneous movement of said cover member and said bail.

11. A shield for use in a cash drawer as defined in claim 1 wherein;

there are a plurality of paper currency compartments and one insert including at least an overlay portion for each compartment.

12. A shield for use in a cash drawer as defined in claim 1 wherein:

said cooperative means includes holding means to retain said bail to said overlay portion.

13. A shield for use in a cash drawer as defined in claim 1 wherein:

said cooperative means is a pivot pin.

* * * * *